US005345784A

United States Patent [19]

Bazemore et al.

[11] Patent Number: 5,345,784

[45] Date of Patent: Sep. 13, 1994

[54] SALAD BOWL HAVING A REFRIGERANT CHAMBER

[76] Inventors: Gertrude R. Bazemore; Mark A. Cardy, both of T-4 English Village Apartments, North Wales, Pa. 19454

[21] Appl. No.: 69,506

[22] Filed: Jun. 1, 1993

[51] Int. Cl.[5] ..... F25D 3/08

[52] U.S. Cl. ..... 62/371; 62/457.6

[58] Field of Search ..... 62/457.1, 457.2, 457.3, 62/457.6, 530, 529, 371

[56] References Cited

U.S. PATENT DOCUMENTS

| | | | |
|---|---|---|---|
| D. 280,688 | 9/1985 | Laslo | D7/5 |
| D. 323,097 | 1/1992 | Picozza | D7/542 |
| 1,083,718 | 1/1914 | Wright | 62/457.6 |
| 1,123,793 | 1/1915 | Pick | 62/457.6 |
| 3,605,433 | 9/1971 | Strathaus | 62/371 |
| 3,710,589 | 1/1973 | Brown et al. | 62/457.6 |
| 4,351,164 | 9/1982 | Christiani | 62/315 |
| 4,520,633 | 6/1985 | Hoydic | 62/457 |
| 4,981,234 | 1/1991 | Slaughter | 220/415 |
| 5,088,301 | 2/1992 | Piepenbrink | 62/457.6 |
| 5,090,213 | 2/1992 | Glassman | 62/457.3 |
| 5,177,981 | 1/1993 | Haas | 62/457.3 |
| 5,231,850 | 8/1993 | Morris | 62/457.6 |

*Primary Examiner*—Henry A. Bennett
*Assistant Examiner*—William C. Doessler
*Attorney, Agent, or Firm*—Rhodes and Ascolillo

[57] ABSTRACT

A refrigerated salad bowl for maintaining the contents thereof at a temperature that is substantially below the temperature of the ambient environment, the salad bowl including a substantially concave shaped interior bowl, a substantially concave shaped exterior bowl, the interior bowl and the exterior bowl each having a rim, the interior bowl being substantially smaller than the exterior bowl and being disposed substantially within the exterior bowl to thereby form a chamber therebetween, a surface joining the rim of the interior bowl and the rim of the exterior bowl, the surface bounding, at least in part, the chamber, a vent hole communicating with the chamber and provided in the surface joining the rims of the interior and exterior bowls, and a lid for covering the interior bowl.

20 Claims, 2 Drawing Sheets

SALAD BOWL HAVING A REFRIGERANT CHAMBER

BACKGROUND

1. Field of the Invention

The present invention relates to the field of food containers, most particularly salad containers that are designed to extend the freshness of the food stored therein.

Picnics and cookouts are popular recreational pastimes during the summer months. A potential hazard for outdoor eating, however, is food spoilage. Foods subject to spoilage can be kept in a picnic cooler up until serving time. However, once people begin to eat, such foods are usually removed from the cooler and placed on the table, where it may sit for several hours while people eat, talk, play games, etc. Many typical picnic foods which contain mayonnaise or salad dressing, such as potato salad, are particularly susceptible to food spoilage. The present invention is directed toward solving this problem. 2. Description of the Related Art U.S. Pat. No. 4,520,633 relates to a salad bowl having a relatively fiat interior partition that separates the bowl into an upper food-containing receptacle and a lower ice-containing chamber.

U.S. Pat. No. 3,605,433 relates to a bowl having a refrigerant containing compartment suspended from a lid and thermally insulated therefrom, in order to prevent frosting of the bowl and lid.

U.S. Pat. No. 4,351,164 discloses a salad bowl constructed of unglazed terra cotta pottery which, when moistened, reduces the temperature of the bowl's contents through evaporation.

Finally, U.S. Design Pat. Nos. 280,688 and 323,097 disclose decorative designs for salad bowls.

SUMMARY OF THE INVENTION

In one aspect, the invention generally features a refrigerated salad bowl for maintaining the contents thereof at a temperature that is substantially below the ambient temperature, the salad bowl including: an exterior bowl member; an interior bowl member; the interior bowl member being disposed substantially within the exterior bowl member and spaced therefrom to define a refrigerant chamber between the exterior bowl member and the interior bowl member; a vent apparatus for venting the refrigerant chamber to the ambient atmosphere; and a lid for covering the interior bowl member.

Preferably, the interior bowl member additionally includes a circumferential radially extending flange, the circumferential radially extending flange being joined to the exterior bowl member; the vent apparatus includes an aperture provided in the circumferential radially extending flange, the aperture connecting with the refrigerant chamber; the interior bowl member is removable from the exterior bowl member, and the salad bowl additionally includes a releasable fluid impenetrable seal apparatus between the radially extending flange and the exterior bowl member for preventing the escape of the refrigerant from the refrigerant chamber; the releasable fluid impenetrable seal apparatus includes an upstanding peripheral flange provided on one of the interior bowl member and the exterior bowl member, and a peripheral recessed channel provided on the other of the interior bowl member and the exterior bowl member; the upstanding peripheral flange is provided on the exterior bowl member, and the peripheral recessed channel is provided on the interior bowl member; the peripheral recessed channel is provided on the radially extending flange of the interior bowl member; the salad bowl additionally includes indicia provided on at least one of the interior and exterior bowl members, the indicia indicating a level for filling the exterior bowl member with the refrigerant, absent the interior bowl member, such that, upon placement of the interior bowl member within the exterior bowl member, the refrigerant chamber will be substantially filled with the refrigerant; the lid includes a hinge, the hinge separating the lid into two lid portions, the two lid portions being pivotable about the hinge with respect to one another; the salad bowl additionally includes an opening provided in the lid for positioning a utensil; and each of the interior bowl member, the exterior bowl member, and the lid are constructed from a resilient plastic material, and the salad bowl additionally includes an additional seal apparatus for sealing the lid to the interior bowl member.

In another aspect, the invention generally features a refrigerated salad bowl for maintaining the contents thereof at a temperature that is substantially below the temperature of the ambient environment, the salad bowl including: a substantially concave shaped interior bowl; a substantially concave shaped exterior bowl; the interior bowl and the exterior bowl each having a rim; the interior bowl being substantially smaller than the exterior bowl and being disposed substantially within the exterior bowl to thereby form a chamber therebetween; a surface joining the rim of the interior bowl and the rim of the exterior bowl, the surface bounding, at least in part, the chamber; a vent hole communicating with the chamber and provided in the surface joining the rims of the interior and exterior bowls; and a lid apparatus for covering the interior bowl.

Preferably, the lid apparatus includes a lid member having a periphery substantially corresponding to the rim of the interior bowl, and the salad bowl additionally includes a releasable seal between the periphery of the lid member and the rim of the interior bowl; the lid member includes a hinge, the hinge substantially bisecting the lid member and thereby dividing the lid member into first and second lid portions; the first lid portion being pivotable, about the hinge, away from the rim of the interior bowl, while the second lid portion remains in contact with the rim of the interior bowl; the salad bowl additionally includes a radially inward extending notch provided in the lid member, the notch being dimensioned to accommodate the handle of a serving utensil; the interior bowl is removable from the exterior bowl, the surface joining the rims of the interior and exterior bowls is formed integrally with the interior bowl, and the salad bowl additionally includes a releasable fluid impenetrable seal between the surface and the rim of the exterior bowl; and the salad bowl additionally includes a fill line indicia provided on the exterior bowl, the fill line indicia indicating a level for filling the exterior bowl with a fluid, absent the interior bowl, such that, upon placement of the interior bowl within the exterior bowl, the chamber will be substantially filled with the fluid, and each of the interior bowl, the exterior bowl, and the lid member are constructed from a resilient plastic material;

In yet another aspect, the invention generally features a refrigerated salad bowl for maintaining the contents thereof at a substantially reduced temperature, the salad bowl including: a substantially concave shaped interior bowl having a rim and an integrally formed flange extending radially outward from the rim; a substantially concave shaped exterior bowl having a rim; the exterior bowl being of substantially greater dimensions than the interior bowl, and the exterior bowl being disposed about the interior bowl such that the rims of the exterior and interior bowls are substantially coplanar and such that a chamber is formed between the exterior and interior bowls; the flange of the interior bowl connecting with the rim of the exterior bowl; a vent hole passing through the flange; a lid member having a periphery substantially matching the rim of the interior bowl; a releasable seal between the periphery of the lid member and the rim of the interior bowl; and a hinge substantially bisecting the lid member and thereby dividing the lid member into first and second lid portions; the first lid portion being removable from the rim of the interior bowl by a pivoting motion about the hinge while the second lid portion remains sealed to the rim of the interior bowl by the releasable seal.

Preferably, the integrally formed flange of the interior bowl connects to the rim of the exterior bowl through a releasable fluid impenetrable seal between the periphery of the integrally formed flange and the rim of the exterior bowl; and the salad bowl additionally includes a notch extending radially inward from the periphery of the lid member, the notch being dimensioned to accommodate the handle of a serving utensil, and a fill line marked on a surface of the exterior bowl.

One object of the present invention is the provision of a salad bowl that will maintain its contents at a substantially reduced temperature as compared to the ambient environment.

Another object of the invention is the provision of such a salad bowl that is easy to use and that can be easily cleaned and maintained in a sanitary condition.

A still further object of the invention is the provision of such a salad bowl that is simple in construction and, therefore, inexpensive to manufacture.

The invention will now be described by way of a particularly preferred embodiment, reference being made to the accompanying drawings, wherein:

DESCRIPTION OF THE PREFERRED EMBODIMENT

Figure 1:
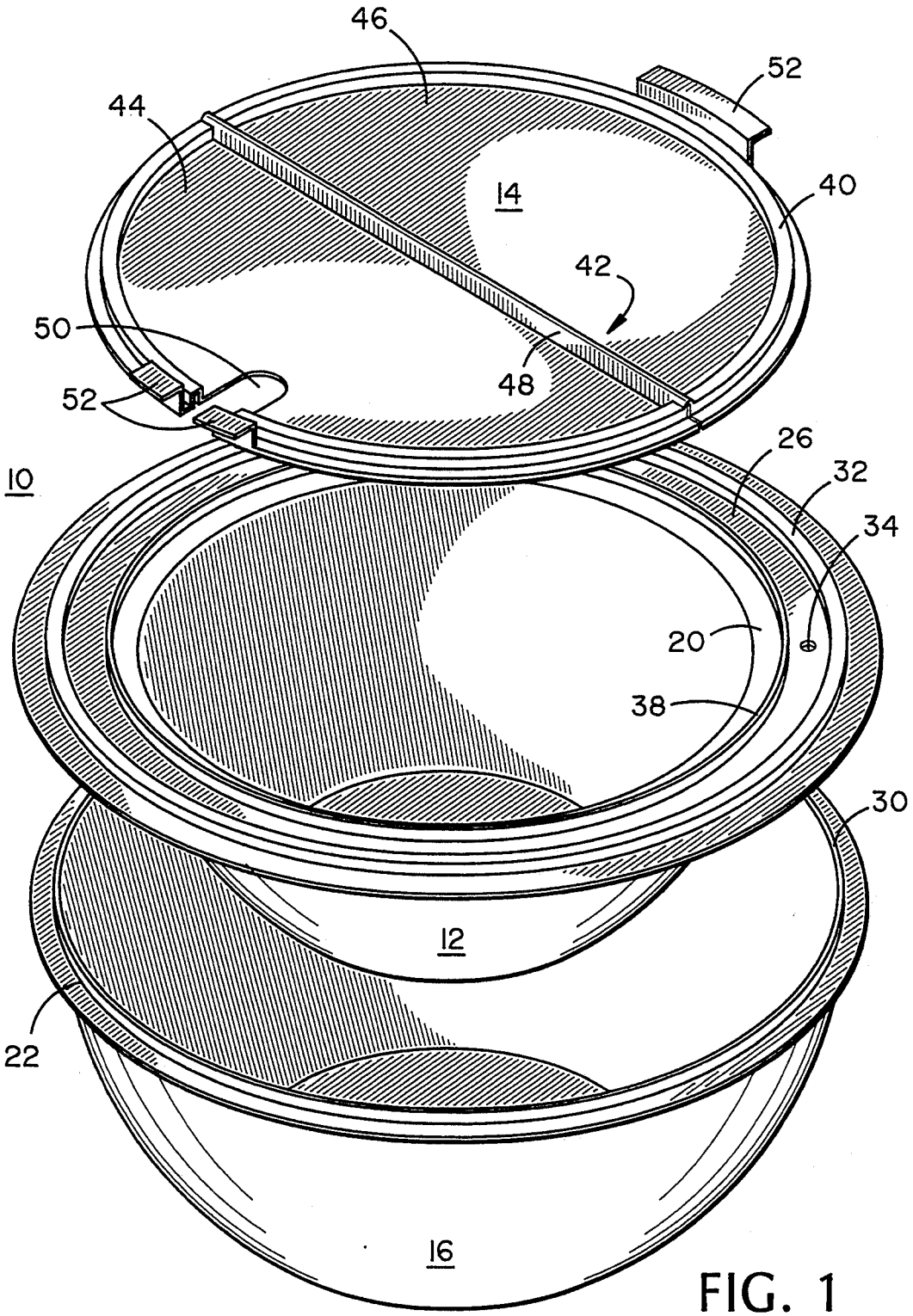
FIG. 1 is an exploded perspective view of a salad bowl constructed according to the present invention.
Figure 2:
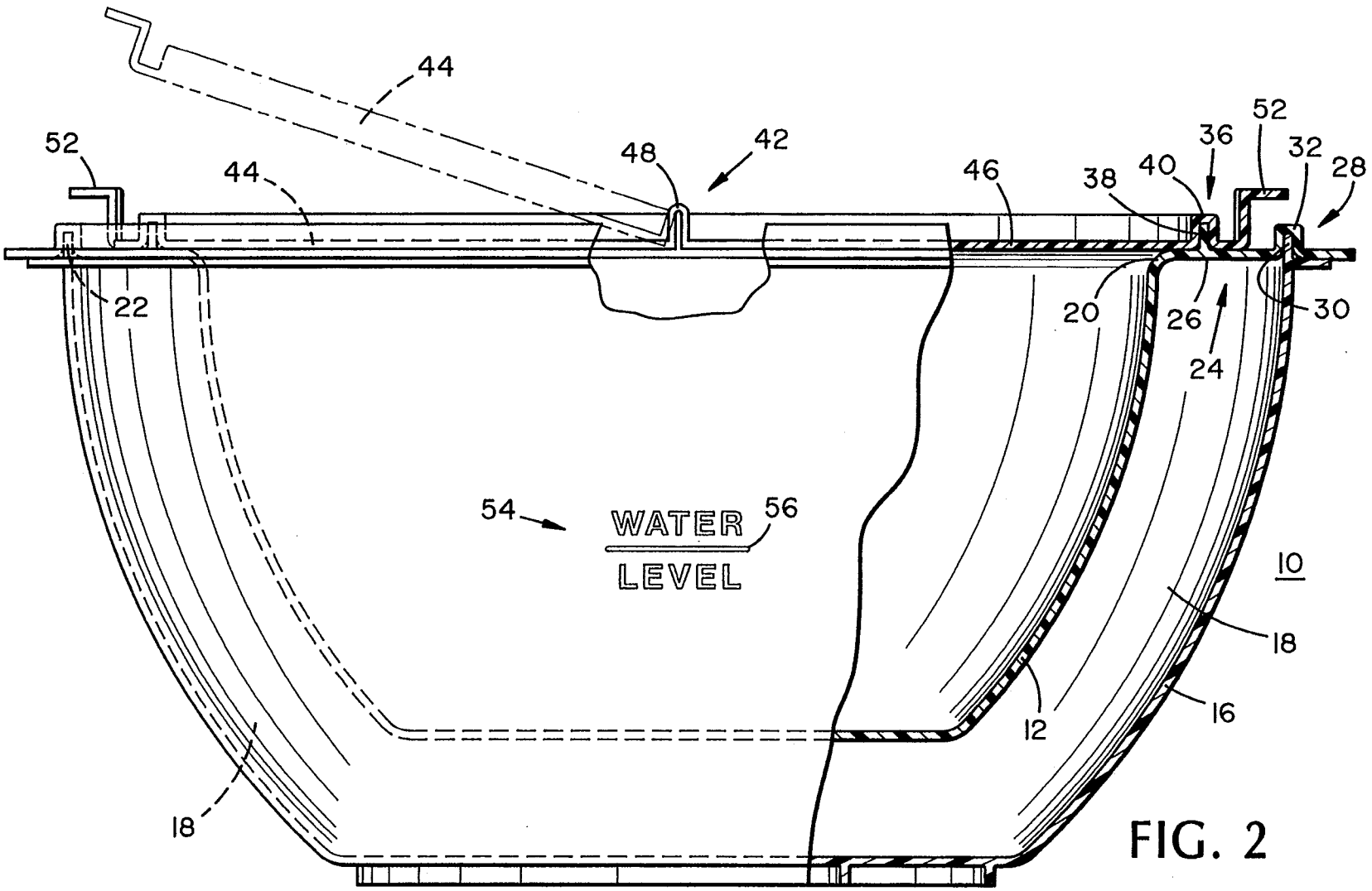
FIG. 2 is an elevational view, in partial cross section, through the salad bowl of FIG. 1.

Referring most particularly now to FIG. 1, a salad bowl 10 constructed according to the present invention generally includes an interior bowl 12, a lid 14 for covering the interior bowl 12, and an exterior bowl 16. As shown, both the interior bowl 12 and the exterior bowl 16 are of the same general configuration, namely, a smoothly rounded concave shape having a flattened bottom surface. The interior bowl 12 is of proportionally reduced scale as compared to the exterior bowl 16, such that, as is shown most clearly in FIG. 2, when the interior bowl 12 is placed substantially within the exterior bowl 16, a chamber 18 is formed between the interior surface of the exterior bowl 16 and the exterior surface of the interior bowl 12. Preferably, the interior bowl 12, the lid 14, and the exterior bowl 16 are all constructed from a resilient and durable plastic, such materials being well known in the field of storage containers.

Each of the interior and exterior bowls 12 and 16, respectively, is provided with a rim 20 and 22, respectively. The two rims 20 and 22 are joined to one another so as to substantially enclose the chamber 18. Preferably, a surface 24 joins the two rims 20 and 22, and even more preferably, the surface 24 is a flange 26 that is formed integrally with the interior bowl 12 and that extends radially outward from the rim 20 thereof. A fluid impenetrable seal 28 is provided at the point of connection of the periphery of the flange 26 and the rim 22 of the exterior bowl 16. The fluid impenetrable seal 28 is releasable and is generally of the type often used in plastic storage containers, particularly such containers as are used for refrigerated food storage. More particularly, the fluid impenetrable seal 28 includes an upstanding peripheral flange 30 provided on the rim 22 of the exterior bowl 16 and a corresponding recessed channel 32 provided on the periphery of the flange 26, the flange 30 and the channel 32 resiliently interlocking with one another to thereby form the fluid impenetrable seal 28.

As is seen most clearly in FIG. 1, the flange 26 is provided with a vent hole 34. As discussed more fully below, the vent hole 34 places the chamber 18 in communication with the ambient atmosphere and, therefore, allows the escape of air from the chamber 18.

The lid 14 is of generally circular configuration, and an additional seal 36 is provided between the periphery of the lid 14 and the rim 20 of the interior bowl 12. The additional seal 36 is also releasable and is of the same general construction as the fluid impenetrable seal 28 discussed above. The additional seal 36 includes an additional upstanding flange 38 provided adjacent the rim 20 of the interior bowl 12 and an additional recessed channel 40 positioned on the periphery of the lid 14, the additional flange 38 and the additional recessed channel 40 resiliently interlocking with one another to form the additional seal 36.

The lid 14 also includes a hinged portion 42 that substantially bisects the lid 14 and thereby divides it into first and second lid portions 44 and 46, respectively. As seen most clearly in FIG. 2, the hinged portion 42 preferably consists of an upstanding fold 48 in the material (e.g., a resilient plastic) from which the lid 14 is constructed. The hinged portion 42 enables either of the first or second lid portions 44 or 46 to be removed from contact with the rim 20, via rotation about the hinged portion 42, for access to the contents of the interior bowl 12, while the other of the lid portions 44 or 46 remains sealed to the rim 20.

Referring once again to FIG. 1, the lid 14 is also provided with a notch 50 that extends radially inward from a peripheral edge of the lid 14. The notch 50 is dimensioned and configured to accommodate and support the handle of a serving utensil, for example, a serving spoon. The lid 14 is additionally preferably provided with a pair of angled grips 52 that extend initially upward and then outward from the lid 14, which they are formed unitarily with. The grips 52 enable the easy opening of either the first or second lid portions 44 and 46, respectively, or the removal of the lid 14 entirely.

Finally, the exterior bowl 16 has provided, preferably on the exterior surface thereof, indicia 54 for indicating the proper level to which the exterior bowl 16 is to be filled with a refrigerant, preferably water, prior to insertion of the interior bowl 12 therein. As shown, the indicia 54 preferably consists of the legend "Water Level" accompanied by a fill line 56.

The invention is simple and effective in use. The interior bowl 12 is removed from the exterior bowl 16, and the exterior bowl 16 is filled with water to the proper level, as indicated by the indicia 54. The indicia 54 is placed such that, when the interior bowl 12 is replaced within the exterior bowl 16, the water level will rise to nearly the top of the chamber 18. The vent hole 34 allows air to escape during the replacement of the interior bowl 12. The salad bowl 10 is then preferably placed in a freezer. The vent hole 34 allows for the further escape of air during the freezing process. Once the water has frozen, a food, such as potato salad, can be placed in the interior bowl 12 and kept cold there. The lid 14 protects the food, and the notch 50 serves as a reminder to provide a serving utensil. Moreover, the salad bowl 10 can be easily disassembled into its individual components for thorough cleaning.

Additionally, a number of ice molds that are insertable into the salad bowl 10 can be made in advance, so that they are ready for immediate use. The ice molds are made as described above and merely kept frozen separately from the salad bowl 10.

While the invention has been herein described by way of a particular preferred embodiment, various substitutions of equivalents may be effected without departing from the spirit and scope of the invention as set forth in the following claims.

For example, while frozen water is preferably employed as the refrigerant, other cooling fluids could be employed, e.g., very cold water.

What is claimed is:

1. A refrigerated salad bowl for maintaining the contents thereof at a temperature that is substantially below the ambient temperature, said salad bowl comprising:

an exterior bowl member;

an interior bowl member;

said interior bowl member being disposed substantially within said exterior bowl member and spaced therefrom to define a refrigerant chamber between said exterior bowl member and said interior bowl member;

vent means for venting said refrigerant chamber to the ambient atmosphere; and a lid for covering said interior bowl member.

2. A refrigerated salad bowl according to claim 1, wherein said interior bowl member additionally comprises a circumferential radially extending flange, said circumferential radially extending flange being joined to said exterior bowl member.

3. A refrigerated salad bowl according to claim 2, wherein said vent means comprises an aperture provided in said circumferential radially extending flange, said aperture connecting with said refrigerant chamber.

4. A refrigerated salad bowl according to claim 3, wherein said interior bowl member is removable from said exterior bowl member, and wherein said salad bowl additionally comprises releasable fluid impenetrable seal means between said radially extending flange and said exterior bowl member for preventing the escape of the refrigerant from said refrigerant chamber.

5. A refrigerated salad bowl according to claim 4, wherein said releasable fluid impenetrable seal means comprises an upstanding peripheral flange provided on one of said interior bowl member and said exterior bowl member, and a peripheral recessed channel provided on the other of said interior bowl member and said exterior bowl member.

6. A refrigerated salad bowl according to claim 5, wherein said upstanding peripheral flange is provided on said exterior bowl member, and wherein said peripheral recessed channel is provided on said interior bowl member.

7. A refrigerated salad bowl according to claim 6, wherein said peripheral recessed channel is provided on said radially extending flange of said interior bowl member.

8. A refrigerated salad bowl according to claim 7, said refrigerated salad bowl additionally comprising indicia provided on at least one of said interior and exterior bowl members, said indicia indicating a level for filling said exterior bowl member with the refrigerant, absent said interior bowl member, such that, upon placement of said interior bowl member within said exterior bowl member, said refrigerant chamber will be substantially filled with said refrigerant.

9. A refrigerated salad bowl according to claim 8, wherein said lid comprises a hinge, said hinge separating said lid into two lid portions, said two lid portions being pivotable about said hinge with respect to one another.

10. A refrigerated salad bowl according to claim 9, wherein said salad bowl additionally comprises an opening provided in said lid for positioning a utensil.

11. A refrigerated salad bowl according to claim 10, wherein each of said interior bowl member, said exterior bowl member, and said lid are constructed from a resilient plastic material, and wherein said salad bowl additionally comprises additional seal means for sealing said lid to said interior bowl member.

12. A refrigerated salad bowl for maintaining the contents thereof at a temperature that is substantially below the temperature of the ambient environment, said salad bowl comprising:

a substantially concave shaped interior bowl;

a substantially concave shaped exterior bowl;

said interior bowl and said exterior bowl each having a rim;

said interior bowl being substantially smaller than said exterior bowl and being disposed substantially within said exterior bowl to thereby form a chamber therebetween;

a surface joining said rim of said interior bowl and said rim of said exterior bowl, said surface bounding, at least in part, said chamber;

a vent hole communicating with said chamber and provided in said surface joining said rims of said interior and exterior bowls; and lid means for covering said interior bowl.

13. A refrigerated salad bowl according to claim 12, wherein said lid means comprises a lid member having a periphery substantially corresponding to said rim of said interior bowl, and wherein said salad bowl additionally comprises a releasable seal between said periphery of said lid member and said rim of said interior bowl.

14. A refrigerated salad bowl according to claim 13, wherein said lid member comprises a hinge, said hinge substantially bisecting said lid member and thereby dividing said lid member into first and second lid portions, said first lid portion being pivotable, about said hinge, away from said rim of said interior bowl, while said second lid portion remains in contact with said rim of said interior bowl.

15. A refrigerated salad bowl according to claim 14, wherein said salad bowl additionally comprises a radially inward extending notch provided in said lid member, said notch being dimensioned to accommodate the handle of a serving utensil.

16. A refrigerated salad bowl according to claim 15, wherein said interior bowl is removable from said exterior bowl, wherein said surface joining said rims of said interior and exterior bowls is formed integrally with said interior bowl, and wherein said salad bowl additionally comprises a releasable fluid impenetrable seal between said surface and said rim of said exterior bowl.

17. A refrigerated salad bowl according to claim 16, wherein said salad bowl additionally comprises a fill line indicia provided on said exterior bowl, said fill line indicia indicating a level for filling said exterior bowl with a fluid, absent said interior bowl, such that, upon placement of said interior bowl within said exterior bowl, said chamber will be substantially filled with said fluid, and wherein each of said interior bowl, said exterior bowl, and said lid member are constructed from a resilient plastic material.

18. A refrigerated salad bowl for maintaining the contents thereof at a substantially reduced temperature, said salad bowl comprising:

a substantially concave shaped interior bowl having a rim and an integrally formed flange extending radially outward from said rim;

a substantially concave shaped exterior bowl having a rim;

said exterior bowl being of substantially greater dimensions than said interior bowl, and said exterior bowl being disposed about said interior bowl such that said rims of said exterior and interior bowls are substantially coplanar and such that a chamber is formed between said exterior and interior bowls;

said flange of said interior bowl connecting with said rim of said exterior bowl;

a vent hole passing through said flange;

a lid member for covering said interior bowl, said lid member having a periphery substantially matching said rim of said interior bowl;

a releasable seal between said periphery of said lid member and said rim of said interior bowl; and a hinge substantially bisecting said lid member and thereby dividing said lid member into first and second lid portions;

said first lid portion being removable from said rim of said interior bowl by a pivoting motion about said hinge while said second lid portion remains sealed to said rim of said interior bowl by said releasable seal; and said second lid portion being removable from said rim of said interior bowl by a pivoting motion about said hinge while said first lid portion remains sealed to said rim of said interior bowl by said releasable seal.

19. A refrigerated salad bowl according to claim 18, wherein said integrally formed flange of said interior bowl connects to said rim of said exterior bowl through a releasable fluid impenetrable seal between the periphery of said integrally formed flange and said rim of said exterior bowl, and wherein said salad bowl additionally comprises a notch extending radially inward from said periphery of said lid member, said notch being dimensioned to accommodate the handle of a serving utensil, and a fill line marked on a surface of said exterior bowl.

20. A refrigerated salad bowl according to claim 19, wherein said hinge comprises an upstanding fold in said lid, and wherein said salad bowl additionally comprises at least one angled grip extending upwardly and outwardly from a periphery of said lid.

* * * * *